US008289252B2

(12) United States Patent
Jo et al.

(10) Patent No.: US 8,289,252 B2
(45) Date of Patent: Oct. 16, 2012

(54) LIQUID CRYSTAL DISPLAY DEVICE INCLUDING A DATA ANALYSIS UNIT AND METHOD FOR DRIVING THE SAME

(75) Inventors: Nam-Wook Jo, Gyeonggi-Do (KR); Sung-Hak Jo, Gyeonggi-Do (KR); Dong-Woo Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 699 days.

(21) Appl. No.: 11/584,555

(22) Filed: Oct. 23, 2006

(65) Prior Publication Data

US 2007/0139329 A1 Jun. 21, 2007

(30) Foreign Application Priority Data

Dec. 20, 2005 (KR) ..... 10-2005-0126385

(51) Int. Cl.
*G09G 3/36* (2006.01)

(52) U.S. Cl. ..... 345/89

(58) Field of Classification Search ..... 345/87–111, 345/690

See application file for complete search history.

(56) References Cited

U.S. PATENT DOCUMENTS

| | | | | |
|---|---|---|---|---|
| 6,771,243 | B2 | 8/2004 | Hirohata | |
| 2002/0047818 | A1 * | 4/2002 | Yamamoto et al. | 345/87 |
| 2002/0097252 | A1 * | 7/2002 | Hirohata | 345/690 |
| 2004/0104877 | A1 * | 6/2004 | Kitagawa | 345/88 |
| 2005/0083435 | A1 * | 4/2005 | Itoh et al. | 348/441 |
| 2006/0072044 | A1 * | 4/2006 | Kawamura et al. | 348/797 |
| 2006/0146005 | A1 * | 7/2006 | Baba et al. | 345/102 |
| 2006/0279507 | A1 * | 12/2006 | Nakao et al. | 345/98 |

FOREIGN PATENT DOCUMENTS

| | | | |
|---|---|---|---|
| CN | 1379388 | | 11/2002 |
| JP | 2001-296841 | | 10/2001 |
| JP | 2002-123223 | A | 4/2002 |
| JP | 2002-318569 | A | 10/2002 |
| JP | 2003-280592 | A | 10/2003 |
| JP | 2006-58890 | A | 3/2006 |
| WO | WO 2005081053 | A1 * | 9/2005 |

* cited by examiner

*Primary Examiner* — Chanh Nguyen
*Assistant Examiner* — Sanghyuk Park
(74) *Attorney, Agent, or Firm* — Morgan, Lewis & Bockius LLP

(57) ABSTRACT

A liquid crystal display device includes a data analysis unit to analyze image data of an input image data stream for variation of luminance between the image data, a black data processing unit to insert black data into the input image data stream based on the variation of luminance analyzed by the data analysis unit and to output an output image data stream, and a liquid crystal panel to display images based on the output image data stream output from the black data processing unit.

13 Claims, 3 Drawing Sheets

LIQUID CRYSTAL DISPLAY DEVICE INCLUDING A DATA ANALYSIS UNIT AND METHOD FOR DRIVING THE SAME

This application claims the benefit of the Korean Patent Application No. 10-2005-0126385 filed on Dec. 20, 2005, which is hereby incorporated by reference.

BACKGROUND OF THE INVENTION

1. Field of the Invention

The present invention relates to a liquid crystal display device and a method for driving the same, and more particularly to, a liquid crystal display device and a method for driving the same for improved luminance.

2. Discussion of the Related Art

Among display devices, cathode ray tubes (CRTs) have been primarily used for displaying images. However, recently, liquid crystal display (LCD) devices have been rapidly replacing the CRTs due to their high luminance, clear image quality, and low power driving characteristics. Generally, LCD devices use optical anisotropy of liquid crystals to produce an image by adjusting light transmissivity. Liquid crystal material is injected between two substrates of the LCD device and by applying various amplitudes of electric fields to the liquid crystal, an amount of light transmitted through the substrates can be controlled to display the image.

LCD devices are thin and light weight, provide high quality images, and can be driven with an electric power ⅓ less than CRTs having the same screen size. However, LCD devices have some limitations on the display of images as compared to the CRTs. For example, due to the properties of the liquid crystal such as viscosity and elasticity, the time for the liquid crystal to attain a desired arrangement in reaction to the electrical field is longer than 16.7 ms, which is a typical display cycle of one frame. Thus, when an image that changes every frame is displayed, motion blur may arise due to residual images being displayed. To overcome the imaging problems of the aforementioned LCD device, a variety of image processing techniques are being developed. One such technique involves adapting a driving method for a CRT to be applied to the image display of an LCD device.

FIG. 1A is an illustrative view showing an image display of a CRT. FIG. 1B is an illustrative view showing an image display of an LCD device. As shown in FIG. 1A, in the CRT, image signals are applied in an impulse form for each frame. Since images are displayed in a discontinuous manner according to the impulses, no image is displayed at intervals between the impulses. Accordingly, a phenomenon such as motion blur may not occur.

By contrast, in the LCD device, the liquid crystals continuously respond to image signals that are applied for each frame, thereby affecting the intervals between consecutive images. Accordingly, a phenomenon such as motion blur occurs. That is, as shown in FIG. 1B, a desired response (IR) and an actual response (AR) are different from each other due to the liquid crystal having a constant response speed. Therefore, in order to remove the motion blur phenomenon, the LCD may be adapted to be driven by the impulse driving technique of the CRT as illustrated in FIG. 1A.

FIG. 2A is an illustrative view showing an image signal applied to a unit pixel to imitate the impulse driving technique in an LCD device. As shown in FIG. 2A, black data BD is applied to each unit pixel during a predetermined interval of one frame. The black data BD is an image signal representing the lowest gray level to display a black image. Thus, by displaying an image of the next frame after displaying a black image during a predetermined interval of one frame, residual images from the preceding frame can be removed.

FIG. 2B is an illustrative view showing black data adapted to a continuous image signal. Such black data BD, as shown in FIG. 2B, are applied to pixels for each frame to thus remove residual image. However, if the black data BD are applied to pixels for each frame, the time during which an image is displayed by the pixels is reduced. Thus, the reduced image display time gives rise to a different problem of reduced average luminance of the LCD device.

SUMMARY OF THE INVENTION

Accordingly, the present invention is directed to a liquid crystal display device and a method for driving the same that substantially obviates one or more problems due to limitations and disadvantages of the related art.

An object of the present invention is to provide a liquid crystal display device with improved luminance while preventing the deterioration of an image, and a method for driving the same.

Another object of the present invention is to provide a liquid crystal display device with improved luminance, and a method for driving the same, that operates at a driving frequency that is only slightly higher than normal driving frequency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display device includes a data analysis unit to analyze image data of an input image data stream for variation of luminance between the image data, a black data processing unit to insert black data into the input image data stream based on the variation of luminance analyzed by the data analysis unit and to output an output image data stream, and a liquid crystal panel to display images based on the output image data stream output from the black data processing unit.

In another aspect, the method of driving a liquid crystal display device including a liquid crystal panel having a plurality of pixels arranged thereon, includes the steps of comparing a luminance of an image data in an input image data stream to determine a variation of luminance of the image data, inserting black data into the input image data stream based on the variation of luminance from the comparing step, outputting an output image data stream from the inserting step, and displaying images on the liquid crystal panel based on the output image data stream.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1A:
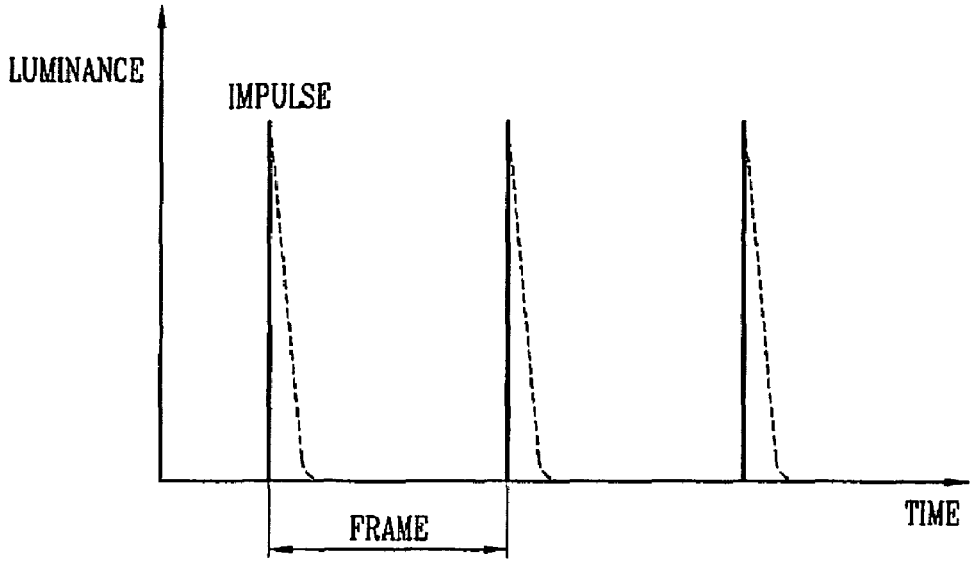
FIG. 1A RELATED ART
FIG. 1A is an illustrative view showing image signals applied to a cathode ray tube according to a related art.
Figure 1B:
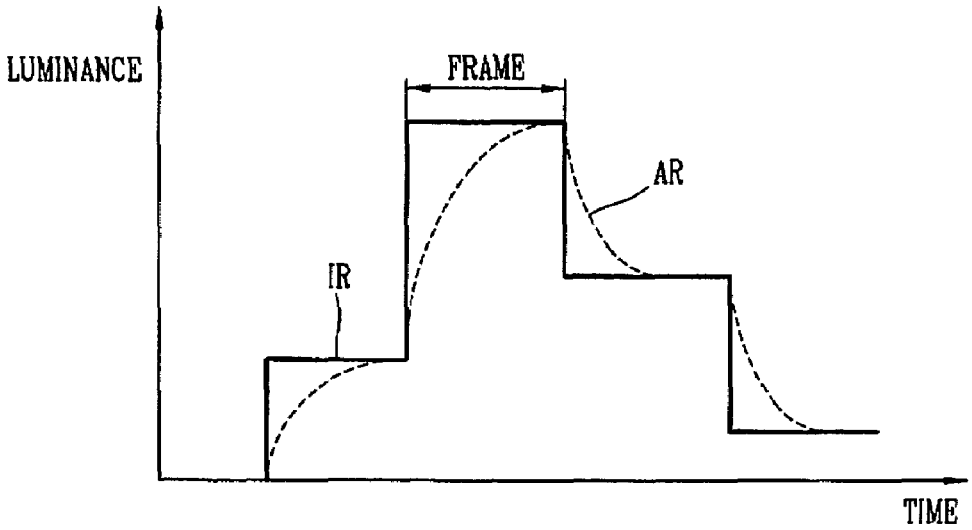
FIG. 1B RELATED ART
FIG. 1B is an illustrative view showing image signals applied to a liquid crystal display device according to a related art.
Figure 2A:
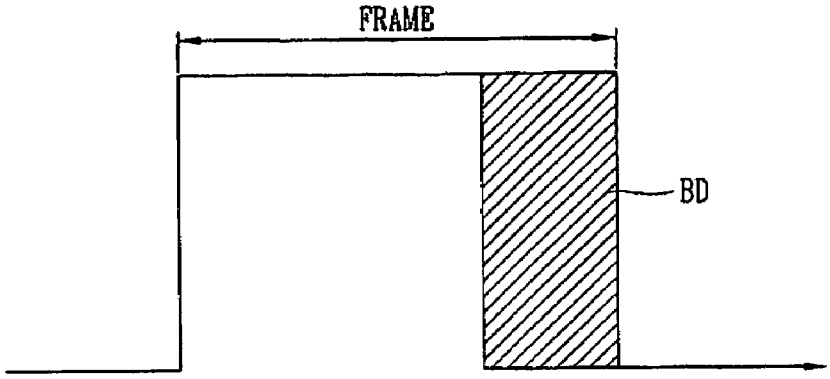
FIG. 2A RELATED ART
FIG. 2A is an illustrative view showing an image data applied to a unit pixel in imitation of impulse driving in a liquid crystal display device according to the related art.
Figure 2B:
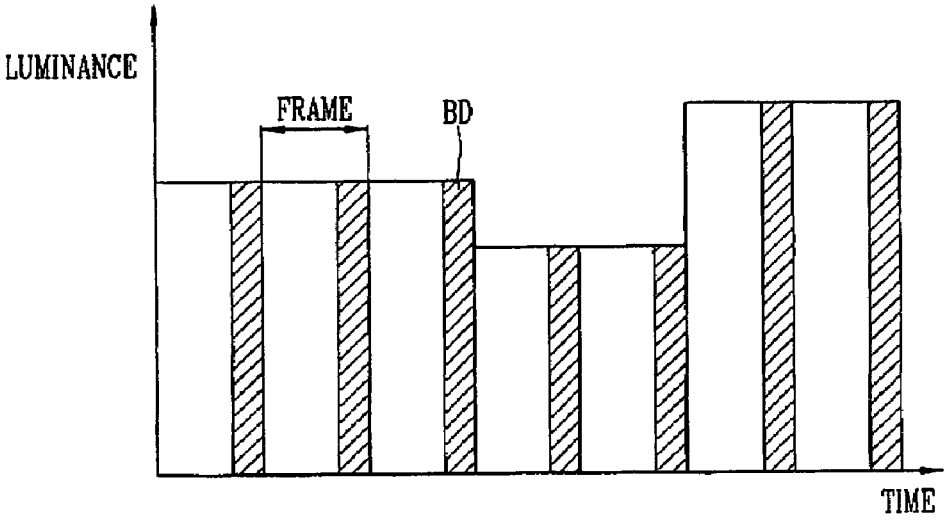
FIG. 2B RELATED ART
FIG. 2B is an illustrative view showing black data adapted to a continuous image signal according to the related art.
Figure 3:
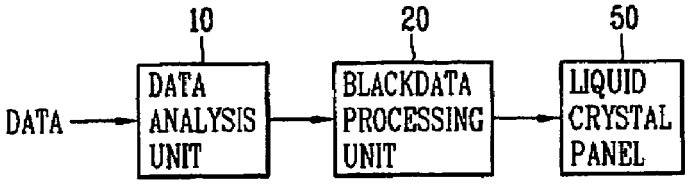
FIG. 3 is a block diagram showing a liquid crystal display device in accordance with an exemplary embodiment of the present invention.

FIG. 3 is a block diagram showing a liquid crystal display (LCD) device in accordance with an exemplary embodiment of the present invention. As shown in FIG. 3, the LCD device in accordance with the present invention includes an image data analysis unit 10 to analyze the variation of luminance by receiving image data DATA, a black data processing unit 20 to insert black data into the image data DATA based on the variation of luminance analyzed by the image data analysis unit 10, and a liquid crystal panel 50 to display images based on the image data DATA output from the black data processing unit 20. The black data inserted to remove a motion blur of images may be the lowest gray level image data. Accordingly, the data analysis unit 10 analyzes the variation of luminance of image data DATA that is continuously input to the LCD device in order to determine whether or not to insert black data.

The data analysis unit 10 analyzes image data DATA pixel by pixel. That is, the variation of luminance is analyzed by comparing the luminance values of image data DATA of two frames that are continuously input into the data analysis unit 10 to provide information regarding the variation of luminance for each pixel to the black data processing unit 20. Based on the comparison of the variation of luminance of image data DATA corresponding to each pixel provided from the data analysis unit 10 with stored luminance variation data, the black data processing unit 20 inserts black data into the image data DATA and outputs modified image data DATA with the inserted black data, or outputs the original image data DATA without the black data.

The liquid crystal panel 50 displays images based on the image data input from the black data processing unit 20. Accordingly, the images displayed on the liquid crystal panel 50 result in the reduction of a motion blur due to the black data inserted based on the variation of luminance. Hereinafter, a method for processing image data DATA in the black data processing unit 20 will be described in detail.

In the image data processing method according to the related art, each pixel is respectively controlled based on the gray level of the image data applied to the pixel. Thus, the driving frequency of the LCD device is increased. Generally, the driving frequency of the LCD device is 60 Hz, and in case of respectively controlling each pixel according to the related art, a high driving frequency of 120 Hz is applied. When a high driving frequency is used, depending on the quality of the LCD device, there may not be enough time for charging the pixels with the image data. Accordingly, the charging properties of the pixels may become insufficient, which may result in degraded picture quality.

Figure 4:
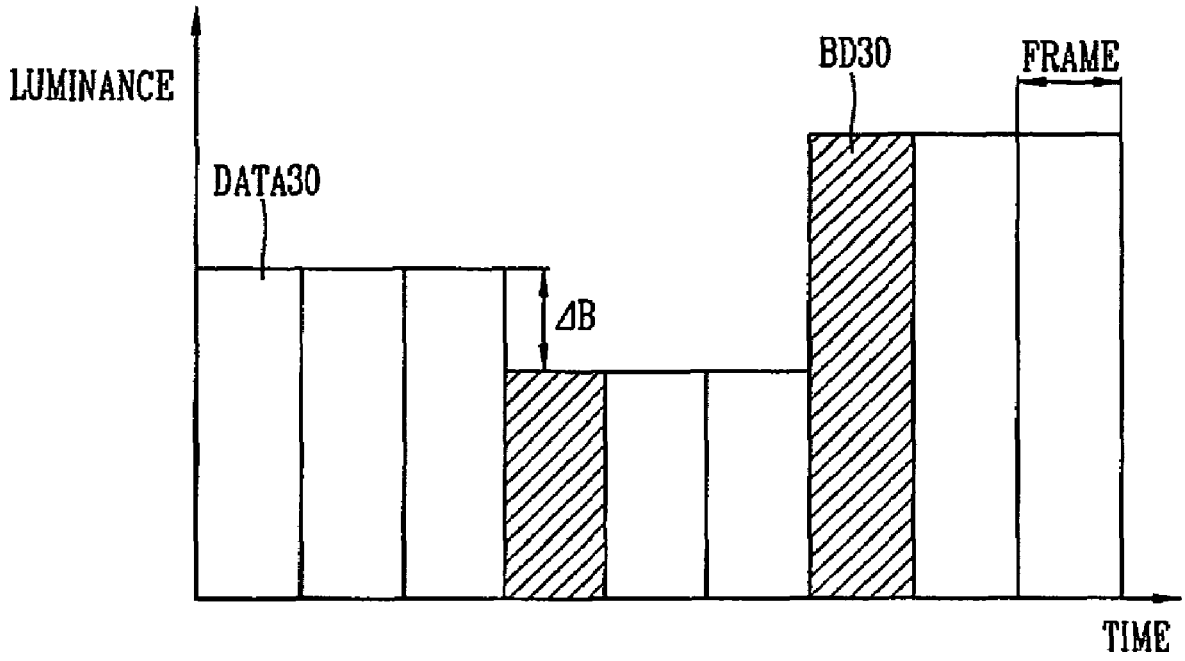
FIG. 4 is an illustrative view showing image data in accordance with a second exemplary embodiment of the present invention.

FIG. 4 is an illustrative view showing image data in accordance with a second exemplary embodiment of the present invention. Even when an image displayed on the liquid crystal panel 50 is a moving picture, the luminance may not change significantly from one frame to the next. Rather, the luminance generally changes over several frames. Because motion blur is caused by residual images left on the screen from the current frame having a different luminance than images of the next frame, motion blur can be eliminated by displaying black data BD30 before displaying the images of the next frame only when there is a change in luminance. That is, as shown in FIG. 4, black data BD30 is not inserted into the image data DATA30 after every frame. Rather, the black data BD30 is not inserted while the image data DATA30 maintains the same gray level from one frame to the next. Rather, the black data BD30 is inserted only when the gray level of the image data DATA30 changes between two frames.

To determine when the black data BD30 is to be inserted, a threshold value of a gray level difference ΔB is defined to be used by the black data processing unit 20 to determine if the black data BD30 is to be inserted. The threshold value of the gray level difference ΔB is set to be large enough to prevent the black data BD30 from being inserted after every frame. Accordingly, if the gray level difference ΔB between the image data DATA30 of the current frame and the image data DATA30 of the next frame is greater than the preset gray value difference threshold, the black data BD30 is inserted during one frame in the next frame.

Although the insertion position of the black data BD30 has been described in the example above as being the frame after the change of the gray level of the image data DATA30, the black data BD30 may alternatively be inserted as the preceding frame right before the change of the gray level of the image data DATA30. That is, the black data BD30 may be inserted after the last frame of the image data DATA30 whose gray level has not yet changed. As an example, if the image data DATA30 of the current frame varies by more than a preset value of ΔB when compared to the gray level of the image data DATA30 of the preceding frame, the black data BD30 having a quantity equal to one frame may be inserted, thereby acquiring the residual image removal effect.

Because the black data BD30 is inserted only when one frame of image data DATA30 changes by more than a preset value of the next frame rather than after every frame, the LCD device according to the present invention may be driven at a driving frequency only slightly higher than 60 Hz. Furthermore, because residual images are removed by inserting black data BD30 only when needed, the original luminance can be achieved in displaying images while the charging properties of pixels are not degraded. While the above-described black data insertion method has been described with respect to an LCD device, the same may be applicable to other display devices.

It will be apparent to those skilled in the art that various modifications and variations can be made in the liquid crystal display device of the present invention, and the method for driving the same, without departing form the spirit or scope of the invention. Thus, it is intended that the present invention cover the modifications and variations of this invention provided they come within the scope of the appended claims and their equivalents.

What is claimed is:

1. A liquid crystal display device, comprising:

a data analysis unit to analyze image data of an input image data stream for variation of luminance between the image data in order to determine whether or not to insert a black data;

a black data processing unit to insert the black data into the input image data stream based on the comparison of the variation of luminance of the image data corresponding to an each pixel analyzed by the data analysis unit and to output an output image data stream with the black data or output an output image data stream without the black data; and a liquid crystal panel to display images based on the output image data stream output from the black data processing unit, wherein when a gray level difference between the image data of a current frame and the image data of an next frame is greater than a preset gray level difference, the black data is inserted as a preceding frame right before a change of the gray level of the image data; and wherein the input image data stream is driven at a frequency of 60 Hz, and the insertion of the black data into the input image data stream causes the output image data stream to be driven at a frequency only slightly higher than 60 Hz, wherein the black data is inserted as an entire frame.

2. The liquid crystal display device of claim 1, wherein the black data is image data having a lowest gray level.

3. The liquid crystal display device of claim 1, wherein the variation of luminance is a luminance difference between two consecutive frames.

4. The liquid crystal display device of claim 1, wherein the black data of at least one pixel is inserted for the entire frame.

5. The liquid crystal display device of claim 1, wherein the black data is inserted for each pixel, respectively.

6. The liquid crystal display device of claim 1, wherein the black data is inserted after a last frame of the image data whose gray level has not yet changed.

7. A method of driving a liquid crystal display device including a liquid crystal panel having a plurality of pixels arranged thereon, comprising the steps of:

comparing a luminance of an image data in an input image data stream to determine a variation of luminance between the image data and determine whether or not to insert a black data;

inserting the black data into the input image data stream, or not, based on the comparison of the variation of luminance of the image data corresponding to an each pixel from the comparing step, wherein when a gray level difference between the image data of a current frame and the image data of an next frame is greater than a preset gray level difference, the black data is inserted as a preceding frame right before a change of the gray level of the image data;

outputting an output image data stream with the black data from the inserting step or outputting an output image data stream without the black data; and displaying images on the liquid crystal panel based on the output image data stream, wherein the input image data stream is driven at a frequency of 60 Hz, and the insertion of the black data into the input image data stream causes the output image data stream to be driven at a frequency only slightly higher than 60 Hz, wherein the black data is inserted as an entire frame.

8. The method of claim 7, wherein the black data is image data having a lowest gray level.

9. The method of claim 7, wherein the variation of luminance is a luminance difference between two consecutive frames.

10. The method of claim 7, wherein the black data of at least one pixel is inserted for the entire frame.

11. The method of claim 7, wherein the black data is inserted for each pixel, respectively.

12. The method of claim 7, wherein the black data is inserted after a last frame of the image data whose gray level has not yet changed.

13. The method of claim 7, wherein the image data for at least one frame in the input image data stream is the same as the image data for at least one frame in the output image data stream.

* * * * *